US006131543A

United States Patent [19]

Achenbach et al.

[11] Patent Number: 6,131,543

[45] Date of Patent: Oct. 17, 2000

[54] OIL PAN FOR AN INTERNAL COMBUSTION ENGINE

[75] Inventors: Karl-Jörg Achenbach, Biedenkopf; Ulrich Bertsch, Burgstetten; Thomas Hardt, Weinstadt; Hubert Schnüpke; Günther Zoll, both of Stuttgart, all of Germany

[73] Assignee: DaimlerChrysler AG, Stuttgart, Germany

[21] Appl. No.: 09/299,192

[22] Filed: Apr. 23, 1999

[30] Foreign Application Priority Data

Apr. 25, 1998 [DE] Germany ..... 198 18 590

[51] Int. Cl.[7] ..... F02F 7/00

[52] U.S. Cl. ..... 123/195 C

[58] Field of Search ..... 123/195 C

[56] References Cited

U.S. PATENT DOCUMENTS 5,531,196 7/1996 Clark ..... 123/195 C
5,960,763 10/1999 Yamamura ..... 123/195 C

FOREIGN PATENT DOCUMENTS 297 06 837 U 7/1997 Germany .

*Primary Examiner*—John Kwon
*Attorney, Agent, or Firm*—Klaus J. Bach

[57] ABSTRACT

In an oil pan for an internal combustion engine particularly for use with a motor vehicle, the oil pan consists of an outer latticed girder structure of a light-weight high-strength material and an inner thin-walled shell of plastic material forming an integral oil pan structure.

10 Claims, 4 Drawing Sheets

OIL PAN FOR AN INTERNAL COMBUSTION ENGINE

BACKGROUND OF THE INVENTION

The invention relates to an oil pan, particularly an oil pan of an internal combustion engine for driving a motor vehicle.

In order to reduce the weight of motor vehicles oil pans of plastic materials are increasingly used instead of metal oil pans. However, oil pans of plastic are relatively sensitive to impacts; they may break when hitting an obstacle. In order to reduce the danger, DE 297068372 proposes to make such oil pans in the bottom area with an inner and an outer shell which shells are interconnected by ribs. The outer shell arranged in the lower area of the oil pan serves as a protection structure. Nevertheless, such an oil pan will not be able to absorb a relatively strong impact. It also appears to be impossible for the oil pan to carry the weight of the engine so that the engine cannot be placed directly onto a floor as this is generally done when the engine is removed from a motor vehicle or before it is installed in a motor vehicle.

It is the object of the present invention to provide an oil pan which is light-weight but, nevertheless, is strong enough to overcome the disadvantages referred to above.

SUMMARY OF THE INVENTION

In an oil pan for an internal combustion engine, particularly for use with a motor vehicle, the oil pan consists of an outer latticed girder structure of a light-weight, high-strength material and an inner thin-walled shell of plastic material forming an integral oil pan structure.

With the oil pan according to the invention, the latticed girder structure accommodates all the forces effective on the oil pan when hitting an obstacle or when the engine is placed onto a floor with the oil pan mounted on the engine. In this arrangement, the plastic shell only serves to enclose the oil containing space. The shell may therefore be thin-walled and accordingly, light-weight.

The manufacture of such an oil pan is very simple and inexpensive since the latticed girder structure is manufactured by injection molding. The latticed girder structure is then placed into a die into which plastic material is injected to form the plastic shell which, in this way, is at the same time firmly joined with the latticed girder structure.

The latticed girder structure preferably consists of a light metal or a fiber reinforced plastic material to save weight. It comprises an upper essentially rectangular frame by way of which the oil pan is mounted to the crankcase of the internal combustion engine. The girder structure includes transverse ribs, which extend between the longitudinal sides of the upper frame from one side around the oil pan to the other side of the upper frame. Preferably, the grid structure includes also ribs at the front side of the oil pan.

For stabilizing the thin walled shell, its longitudinal edges may be interconnected by transverse webs.

An embodiment of the invention will be described below in greater detail on the basis of the accompanying drawings.

DESCRIPTION OF A PREFERRED EMBODIMENT

The oil pan as shown in the figures consists of an outer supportive frame structure 1 (latticed girder structure) consisting of metal, particularly a light metal, or a plastic material with similar strength, for example, a fiber-reinforced plastic material and an inner thin-walled shell 2 of plastic.

Figure 1:
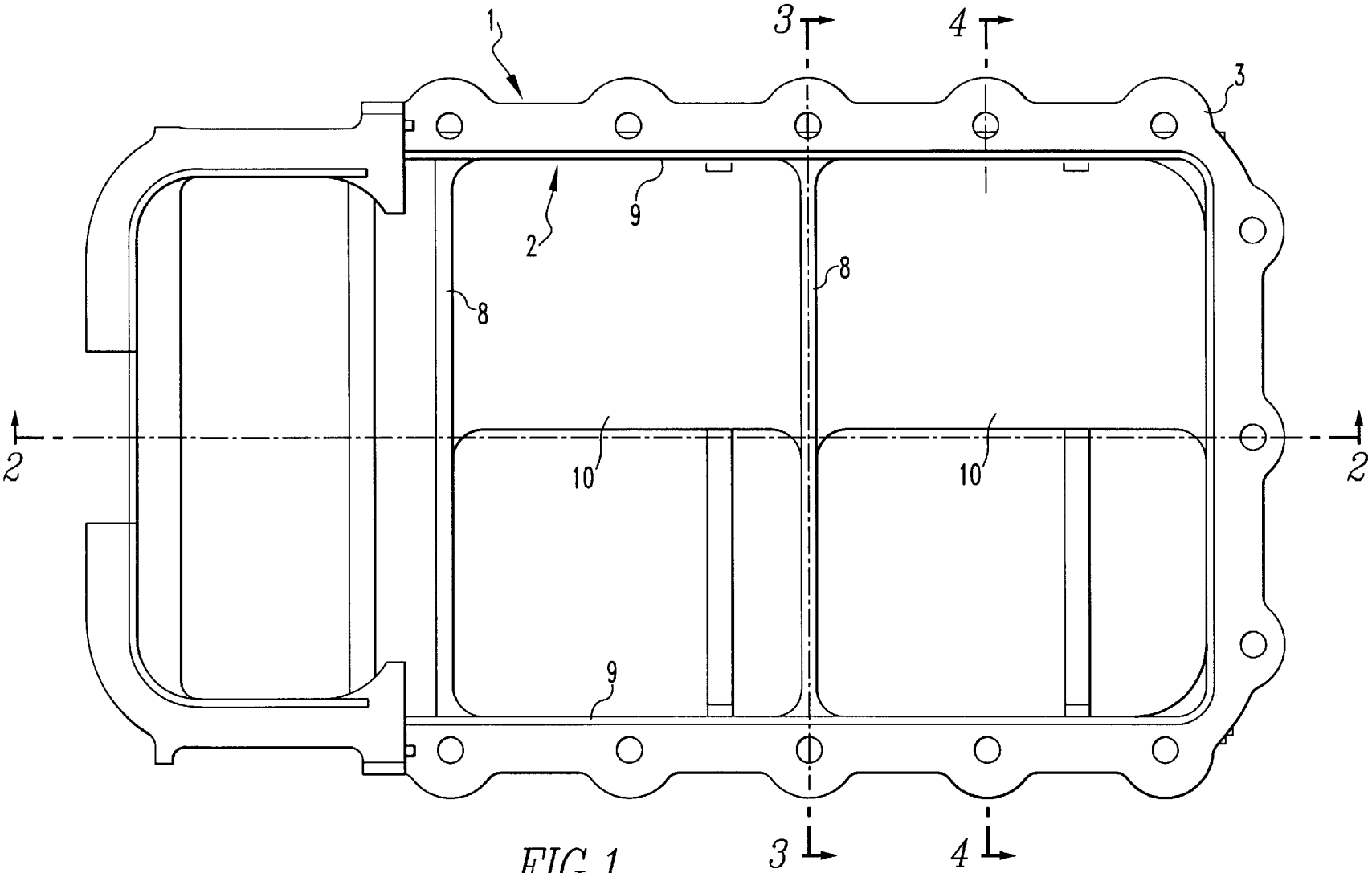
FIG. 1 is a top view of the oil pan.
Figure 2:
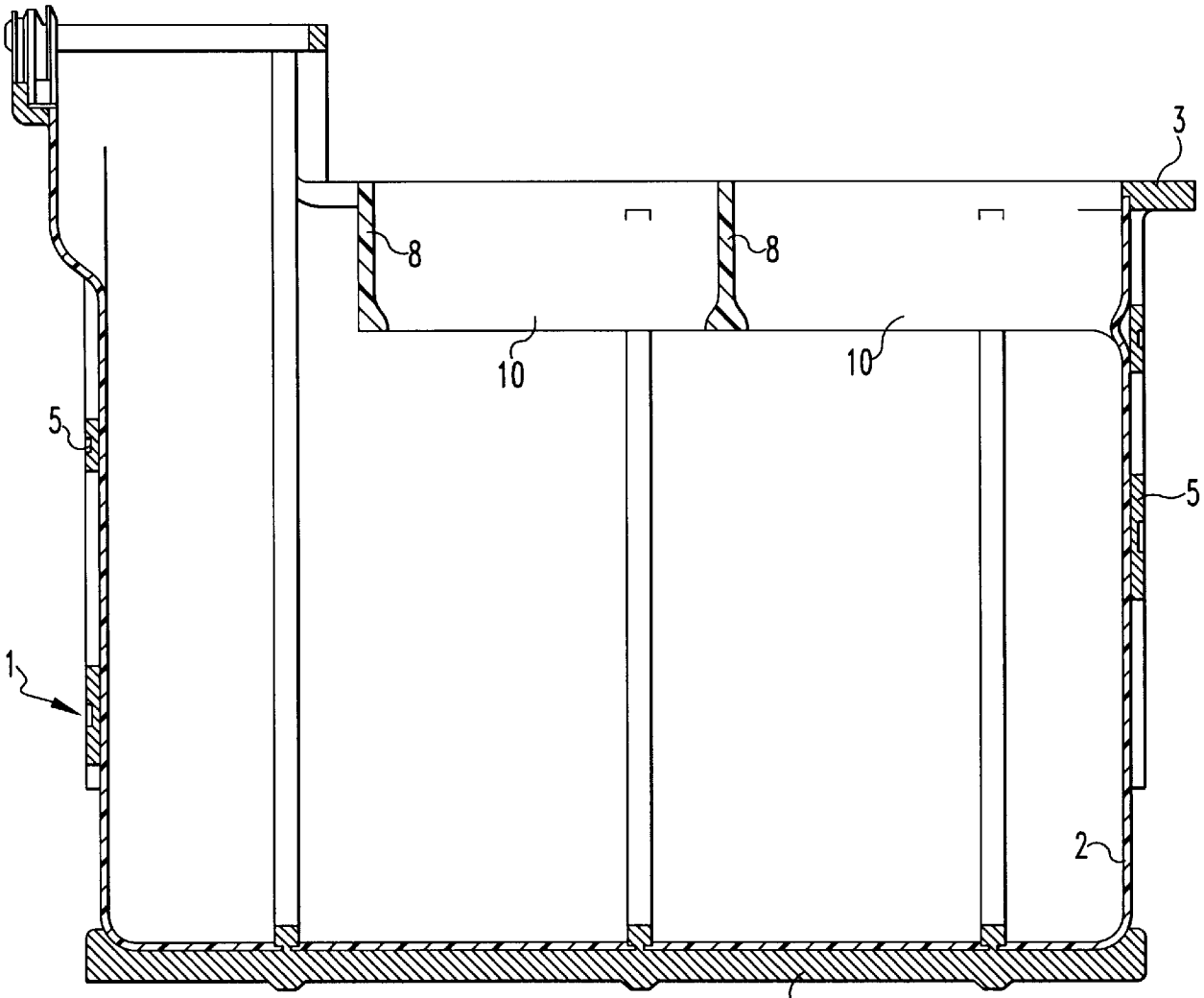
FIG. 2 is a longitudinal cross-sectional view taken along line 2—2 of FIG. 1.
Figure 3:
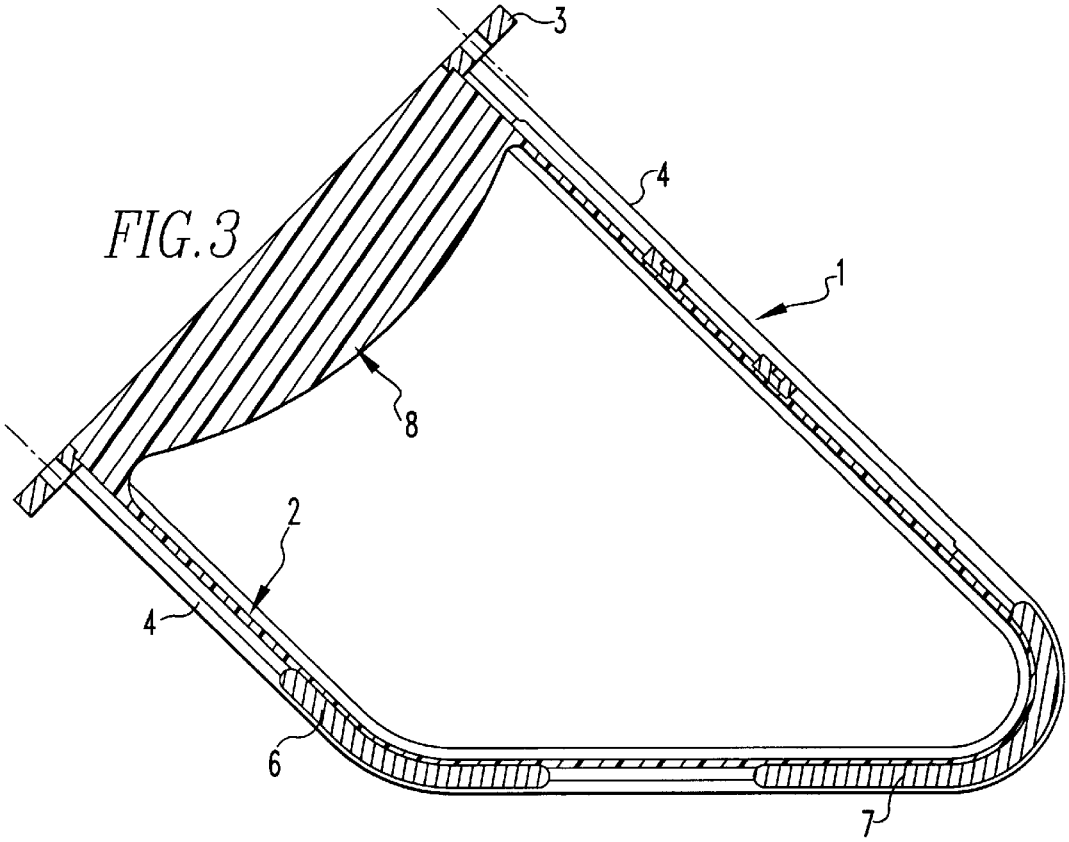
FIG. 3 is a cross-sectional view taken along line 3—3 of FIG. 1.
Figure 4:
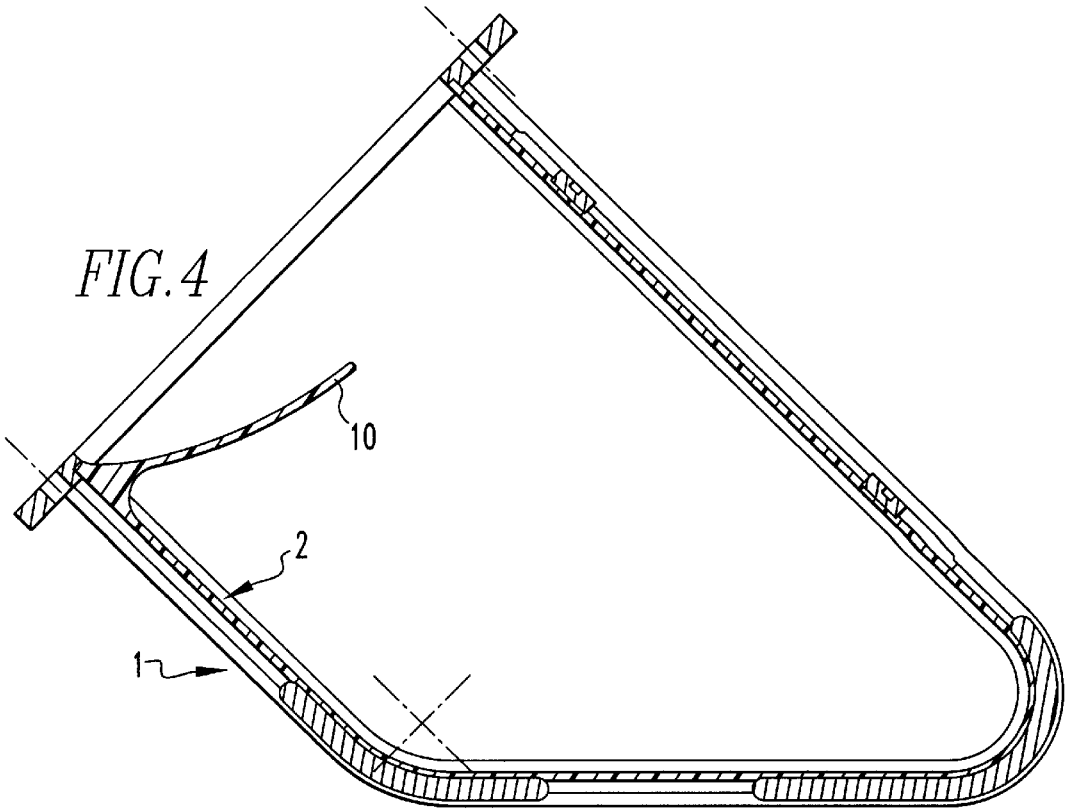
FIG. 4 is a cross-sectional view taken along line 4—4 of FIG. 1.
Figure 5:
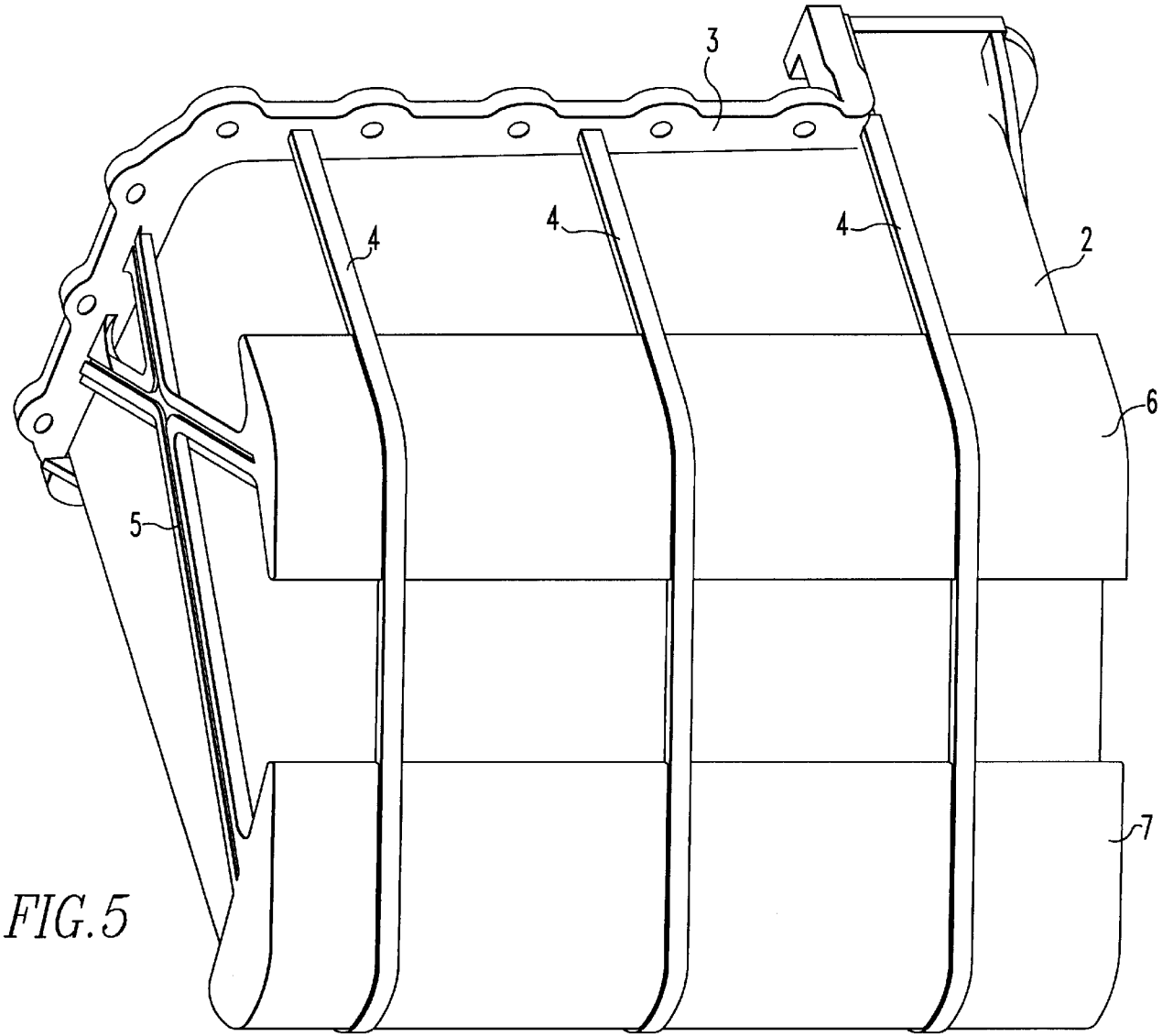
FIG. 5 is a perspective view of the oil pan.

The frame structure 1 comprises an upper essentially rectangular frame 3 by way of which the oil pan is screwed onto the crankcase of an internal combustion engine, which is not shown in the drawings. Transverse ribs 4 extend over the shell 2 between opposite longitudinal parts of the frame 3 as it is apparent from FIG. 5. Additionally, the frame structure 1 includes ribs 5 disposed at the front side of the oil pan. At the lower edges, which are particularly endangered by impacts, there are provided reinforcement sheetings 6 and, respectively, 7, which are initially formed with the latticed girder structure. The reinforcement sheetings protect the thin-walled shell 2 reliably from damages and permit the engine to be placed on a floor with the oil pan attached.

The thin-walled shell includes transverse webs 8, which extend between the longitudinal side edges 9 of the shell 2.

Attached to the oil pan is a so-called oil shoot panel which extends from one side edge of the oil pan toward the interior thereof adjacent the path of movement of the cranks of the crankshaft and which, in a well known manner, reduces turbulence in the oil pan.

What is claimed is:

1. An oil pan for an internal combustion engine, particularly for a motor vehicle, said oil pan comprising an outer latticed girder structure consisting of a light-weight high-strength material and an inner thin-walled shell of plastic material.

2. An oil pan according to claim 1, wherein said inner, thin-walled shell is injection-molded into said latticed girder structure.

3. An oil pan according to claim 1, wherein said latticed girder structure consists of fiber-reinforced plastic material.

4. An oil pan according to claim 1, wherein said oil pan has front and rear end walls and side and bottom walls extending between said front and rear end walls, and said latticed girder structure includes an upper essentially rectangular frame by way of which said oil pan is mounted to a crankcase of an internal combustion engine and transverse ribs extending around said oil pan from one longitudinal side of said rectangular frame around the side and bottom walls of said oil pan to the other.

5. An oil pan according to claim 4, wherein said latticed girder structure includes ribs also at the front end wall of said oil pan.

6. An oil pan according to claim 1, wherein said lattice girder structure has lower corner areas which are subject to impacts if the oil pan is mounted on an engine in a motor vehicle, said corner areas being provided with reinforcement sheetings.

7. An oil pan according to claim 5, wherein said sheetings are formed with said latticed girder structure.

8. An oil pan according to claim 4, wherein said upper frame has longitudinal side members and transverse webs extend between said longitudinal side members.

9. An oil pan according to claim 8, wherein an oil shoot board projects from said inner, thin-walled shell into said oil pan so as to be disposed adjacent the path of movement of cranks of said engine crankshaft for limiting turbulence generated by said cranks.

10. An oil pan according to claim 1, wherein said inner, thin-walled shell is cast into said latticed girder structure.

* * * * *